US010946688B1

(12) United States Patent
Wilson

(10) Patent No.: US 10,946,688 B1
(45) Date of Patent: Mar. 16, 2021

(54) RIGID PAGED BOOK WITH INTERLEAVED BOOK BINDING

(71) Applicant: Alexander Wilson, Surprise, AZ (US)

(72) Inventor: Alexander Wilson, Surprise, AZ (US)

( * ) Notice: Subject to any disclaimer, the term of this patent is extended or adjusted under 35 U.S.C. 154(b) by 0 days.

(21) Appl. No.: 17/105,886

(22) Filed: Nov. 27, 2020

Related U.S. Application Data

(60) Provisional application No. 62/941,621, filed on Nov. 27, 2019.

(51) Int. Cl.
*B42D 1/06* (2006.01)
*B42D 1/00* (2006.01)

(52) U.S. Cl.
CPC ..... *B42D 1/06* (2013.01); *B42D 1/008* (2013.01)

(58) Field of Classification Search
CPC . B42D 1/06; B42D 1/008; B42D 1/00; B42D 1/08
USPC ..... 281/3.1, 15.1, 21.1, 27.2, 27.3, 34, 35; 283/63.1, 64; 402/5, 58
See application file for complete search history.

(56) References Cited

U.S. PATENT DOCUMENTS

| | | | | |
|---|---|---|---|---|
| 4,995,144 | A | 2/1991 | Gateley | |
| 5,410,779 | A | 5/1995 | Esman et al. | |
| 5,493,760 | A | 2/1996 | takimoto | |
| 5,659,929 | A | 8/1997 | Cheng | |
| 5,975,577 | A * | 11/1999 | Gottdiener | G09F 5/04 281/15.1 |
| 6,952,861 | B2 | 10/2005 | Ynosencio | |
| 8,806,716 | B2 | 8/2014 | Ducharme et al. | |
| 8,826,495 | B2 | 9/2014 | Jauvtis et al. | |
| 10,114,424 | B2 | 10/2018 | Campbell et al. | |
| 10,227,808 | B2 | 3/2019 | Siddiqui | |
| 10,364,598 | B2 | 7/2019 | Tazbaz et al. | |

FOREIGN PATENT DOCUMENTS

| | | | | |
|---|---|---|---|---|
| GB | 989084 A * | 4/1965 | | G09F 5/04 |
| WO | WO-2016159758 A1 * | 10/2016 | | B05D 3/067 |

* cited by examiner

*Primary Examiner* — Justin V Lewis
(74) *Attorney, Agent, or Firm* — Invention To Patent Services; Alex Hobson

(57) ABSTRACT

A ridged paged book has an interleaved book binding that incorporates page binding couplers that extend from one page to the other along a binding side to enable each page to open and close. A cover binding coupler extends from the front and/or back cover to an adjacent page and may have a cover portion that is longer than a page portion. This longer cover portion may extend along the recess of the cover to provide stability of the cover binding. Pins extend through the covers and pages along a binding side and into the binding couplers to create a durable binding for the rigid paged book. A ridged paged book may have an interleaved book binding configured proximal to a top and/or bottom edge. A ridged paged book may be made out of metal including the covers and pages and the couplers and pins.

19 Claims, 8 Drawing Sheets

RIGID PAGED BOOK WITH INTERLEAVED BOOK BINDING

CROSS REFERENCE TO RELATED APPLICATIONS

This application claims the benefit of priority to U.S. provisional patent application No. 62/941,621, filed on Nov. 27, 2019; the entirety of which is hereby incorporated by reference herein.

BACKGROUND OF THE INVENTION

Field of the Invention

The invention relates a ridged paged book having an interleaved book binding having couplers extending between the pages to produce the binding.

Background

Binders for book with rigid pages typically comprise adhesives and a binding material that extends across all off the pages, or may include bulky coupling components, such as binder rings that hinder the full opening of the book, or are prone to failure due to stresses exerted by the rigid pages during use.

SUMMARY OF THE INVENTION

The invention is directed to a ridged paged book having an interleaved book binding comprising page binding couplers that extend from one page to the other. The page binding couplers are interleaved along the interleaved book binding to enable each page to open and close. The binding is integral to the pages, wherein the binding does not extend out from the binding side of the pages, thereby enabling full opening or each page, or opening to about 180 degrees or more. A cover binding coupler may extend from the front and/or back cover to an adjacent page and may have a cover portion that is longer than a page portion. This longer cover portion may extend along the recess of the cover to provide stability of the cover binding. Pins extend through the covers and pages along a binding side and into the binding couplers to create a durable binding for the rigid paged book. An exemplary ridged paged book may have an interleaved book binding configured proximal to a top and bottom edge.

An exemplary ridged paged book comprises rigid pages, or pages that are stiff and free standing, such as pages made out of metal, wood, plastic and the like. The pages may be thick to enable an aperture for the pins to be configured along a binding side and may be about 1 mm or more, about 2 mm or more, about 3 mm or more, about 5 mm or more, about 8 mm or more, about 12 mm or more, about 25 mm or more and any range between and including the thickness values provided. In an exemplary embodiment, the ridged paged book consists essentially of metal, wherein the covers and pages are made of metal, the cover and page binding couplers are made of metal and the pins are optionally made of metal.

An exemplary rigid paged book consists essentially of metal and has engraved or machined text on the metal page or pages and also may have engraving or machining on the metal front and/or back cover. The engraving or machining may include text, such as words or sentences, paragraphs and like, and may include images. An exemplary rigid paged book may have 1 or more pages between the front and back cover, such as 4 or more pages, 10 or more pages and the like. An exemplary rigid paged book is portable and may be of a size to enable a single person to carry the book, wherein the length and/or width of the book is no more than about 1 m, no more than about 0.5 m or no more than about 0.25 m, and any range between and including the dimensional values provide.

An exemplary rigid paged book comprises a plurality of pages including a front cover and a back cover, wherein each page has a page aperture extending along a binding side of said page to receive a coupler to form an interleaved book binding assembly. An interleaved book binding assembly comprises pins that extend through a page aperture and through a page binding coupler. The binding couplers are configured in an interleaved pattern forming two rows of binding couplers wherein the first row of binding couplers is offset one page from the other row of binding couplers whereby a pin extends through a page and through the overlapped and staggered page binding coupler.

An exemplary rigid paged book may comprise one or more, two or more, three or more interleaved book binding assemblies. In an exemplary embodiment, a rigid paged book comprises two interleaved book binding assemblies with one configured proximal to a top edge of the pages and the other configured proximal to the bottom edge of the pages. Each page may have a recess to receive the page binding couplers and this recess may be offset from the top and/or bottom edge of the page, wherein a connecting page pin extends through an aperture in the page, into the page recess and through the pin receiver apertures in the page binding couplers and then back into the page aperture. The first and second interleaved book binding assemblies may be configured an offset distance from each other along the binding side or edge of the page.

An exemplary rigid paged book may comprise a plurality of pages, including at least two pages, or three pages or more, about five pages or more, about 10 pages or more and any number of pages between and including the number of pages listed. The couplers of the interleaved book binding assembly may be effectively flush with the binding side of the binding side of the pages to allow the pages to open about 170 degrees or more, or about 180 degrees or more, from an adjacent page, whereby the binding does not limit the degree of opening of the pages. An exemplary rigid paged book may be free standing, wherein it can stand on a bottom edge without additional support, such as a book end.

A cover binding coupler may have a cover extension that is longer than the page binding couplers or it may be a page binding coupler having equal length cover portions and page portions.

The summary of the invention is provided as a general introduction to some of the embodiments of the invention, and is not intended to be limiting. Additional example embodiments including variations and alternative configurations of the invention are provided herein.

BRIEF DESCRIPTION OF SEVERAL VIEWS OF THE DRAWINGS

The accompanying drawings are included to provide a further understanding of the invention and are incorporated in and constitute a part of this specification, illustrate embodiments of the invention, and together with the description serve to explain the principles of the invention.

Figure 1:
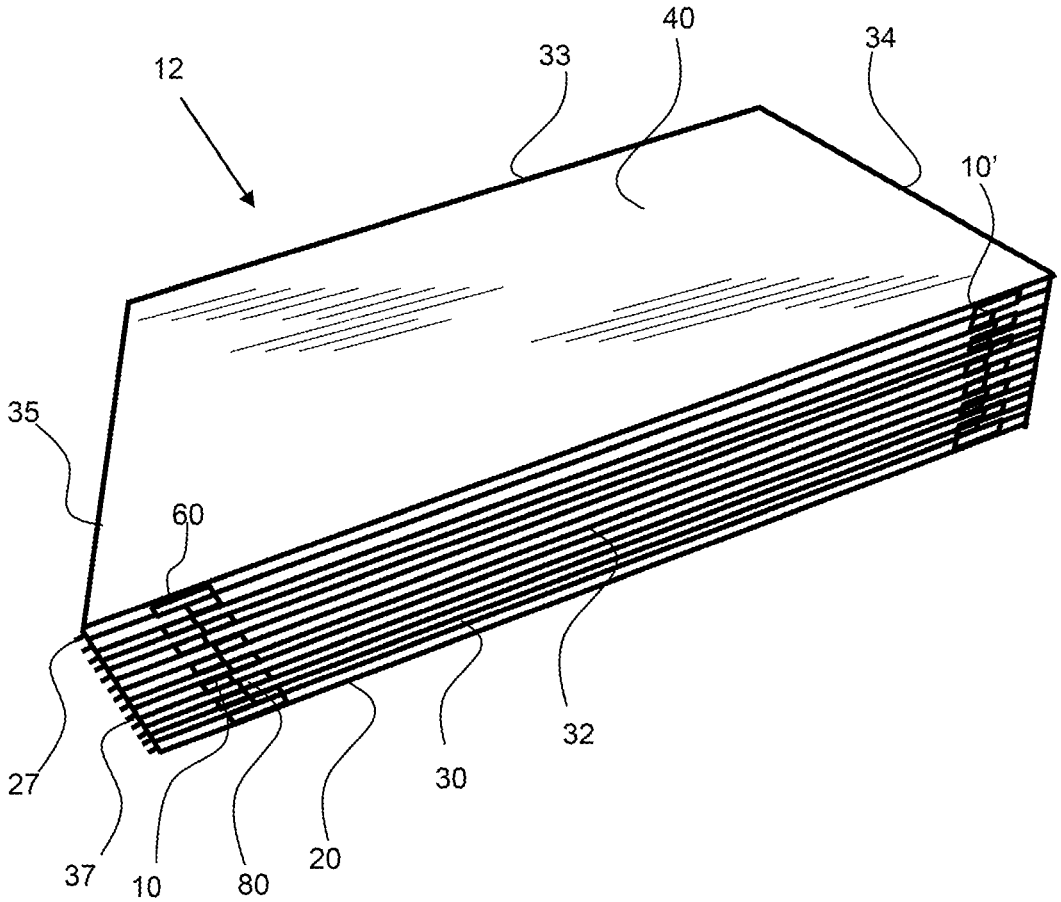
FIGS. 1 and 2 show a perspective view of a book having an interleaved book binding utilizing cover binding couplers and page binding couplers retained by pins that extend through apertures in the cover and pages and through apertures in the binding couplers.

Corresponding reference characters indicate corresponding parts throughout the several views of the figures. The figures represent an illustration of some of the embodiments of the present invention and are not to be construed as limiting the scope of the invention in any manner. Further, the figures are not necessarily to scale, some features may be exaggerated to show details of particular components. Therefore, specific structural and functional details disclosed herein are not to be interpreted as limiting, but merely as a representative basis for teaching one skilled in the art to variously employ the present invention.

DETAILED DESCRIPTION OF THE ILLUSTRATED EMBODIMENTS

As used herein, the terms "comprises," "comprising," "includes," "including," "has," "having" or any other variation thereof, are intended to cover a non-exclusive inclusion. For example, a process, method, article, or apparatus that comprises a list of elements is not necessarily limited to only those elements but may include other elements not expressly listed or inherent to such process, method, article, or apparatus. Also, use of "a" or "an" are employed to describe elements and components described herein. This is done merely for convenience and to give a general sense of the scope of the invention. This description should be read to include one or at least one and the singular also includes the plural unless it is obvious that it is meant otherwise.

Certain exemplary embodiments of the present invention are described herein and are illustrated in the accompanying figures. The embodiments described are only for purposes of illustrating the present invention and should not be interpreted as limiting the scope of the invention. Other embodiments of the invention, and certain modifications, combinations and improvements of the described embodiments, will occur to those skilled in the art and all such alternate embodiments, combinations, modifications, improvements are within the scope of the present invention.

Figure 2:
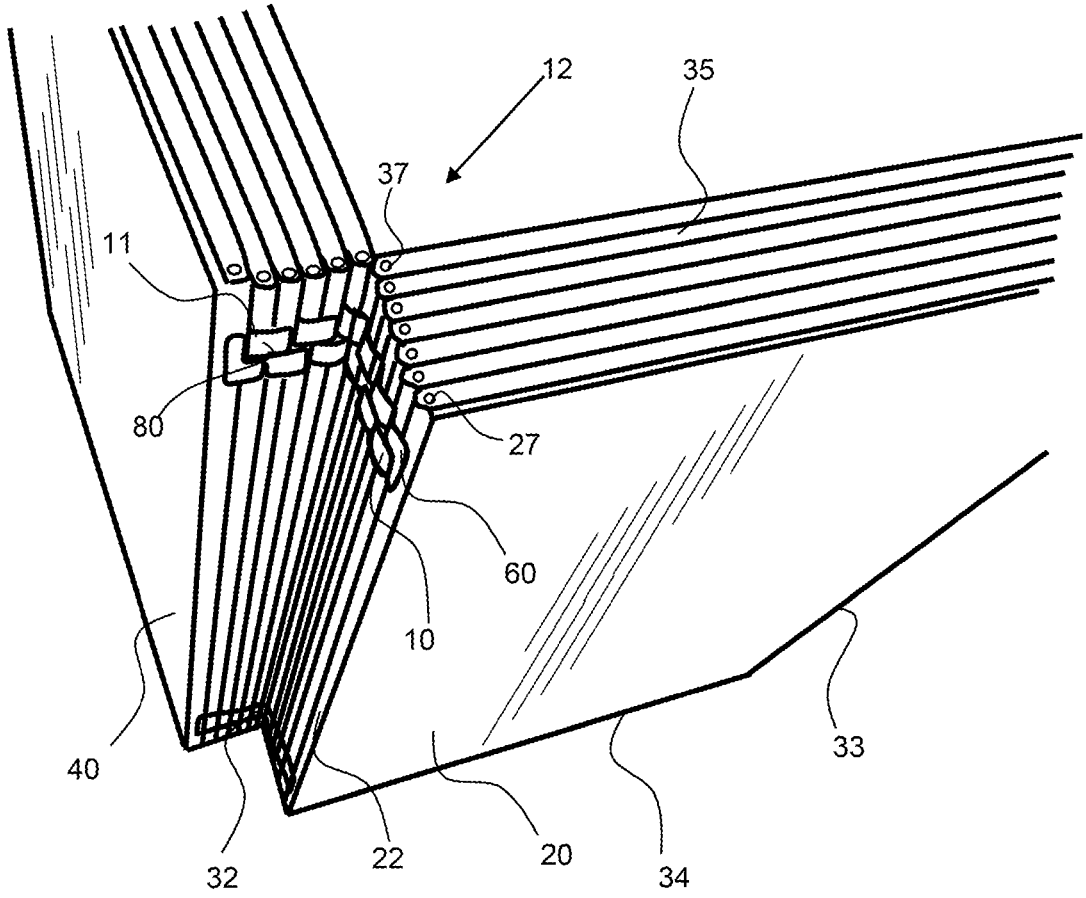
Figure 3:
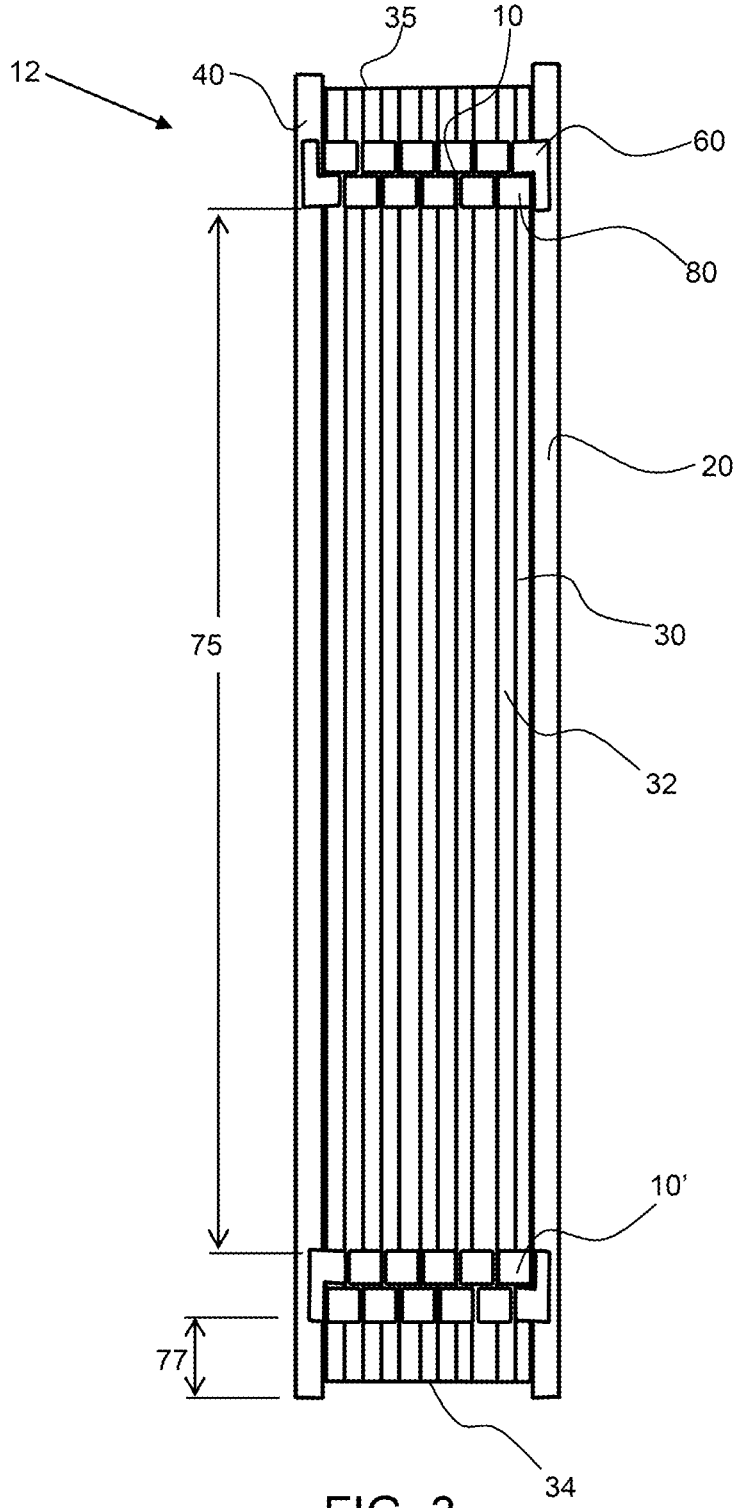
FIG. 3 shows a binding side view of an exemplary rigid paged book.

Referring now to FIGS. 1 to 3, an exemplary rigid paged book 12 has an interleaved book binding assembly 10 utilizing cover binding couplers 60 for the front cover 20 and the back cover 40 and page binding couplers 80 for the pages of the book. The cover binding couplers are coupled to the cover pages by cover pins 27 and the pages are coupled to the page binding couplers by page pins 37. A cover pin 27 extends from the top edge 35 of the cover 20 through a cover aperture extending along the binding side 22 of the cover and into the cover binding coupler 60. Page pins 37 extend from the edge of the pages through a page aperture extending along the binding side 32 of the page and into the page binding coupler 80. Pins extend through the covers and through the cover binding couplers to retain the front and back cover to adjacent pages of the book. Note that these pins may be pressed into the covers and pages to eliminate the pins extension from the top and/or bottom edge of the book, shown in FIG. 1 for clarity of assembly. Pins extend through each of the pages and through a page binding coupler to retain the pages to the interleaved book binding. The cover binding couplers have a cover portion and a page portion with separate apertures for receiving a cover pin and a page pin respectively to couple the cover to the adjacent page. The page binding couplers have a first page portion and second page portion for receiving a first page pin and a second page pin respectively to couple the first and second pages together. The page binding couplers are interleaved to produce the binding for the book. The pages of the exemplary rigid paged book, including the cover and back cover pages, have a top edge 35, a bottom edge 34, a binding side 32 and an extended side 33. The exemplary rigid paged book shown in FIGS. 1 and 2 comprises two interleaved book binding assemblies 10, 10' configured proximal to the top and bottom edges.

As shown in FIG. 2 the exemplary rigid paged book 12, is opened and the binder 11 enables the book to rotate open about any of the pages. The binding is flexible, wherein the binding enables the book pages to rotate about and of the binding couplers.

As shown in FIG. 3, the rigid paged book 12 is configured with two interleaved book binding assemblies, 10, 10'. The first interleaved book binding assembly 10 is configured proximal to the top edge 35 and the second interleaved book binding assembly 10' is configured proximal to the bottom edge 34 of the book, an offset distance 75 from the first interleaved book binding assembly. Each of the interleaved book binding assemblies is configured an offset distance 77 from the closest edge of the book, wherein a page pin extends through the page aperture at a first edge, into the page pin receiver of the page binding coupler of the first interleaved book binding assembly, back into the page aperture that extends between the two interleaved book binding assemblies, into the page pin receiver of the page binding coupler of the second interleaved book binding assembly and finally into the page aperture. Note that the pin may only extend between the page configured between the two interleaved book binding assemblies and through the page binding couplers. The pages may extend past the interleaved book binding assemblies and may have a recessed area extending from the interleaved book binding assemblies to the edge of the page. Note that the rigid paged book may be more durable and stable when the pin extends through a page aperture on either side of the interleaved book binding assembly.

Figure 4:
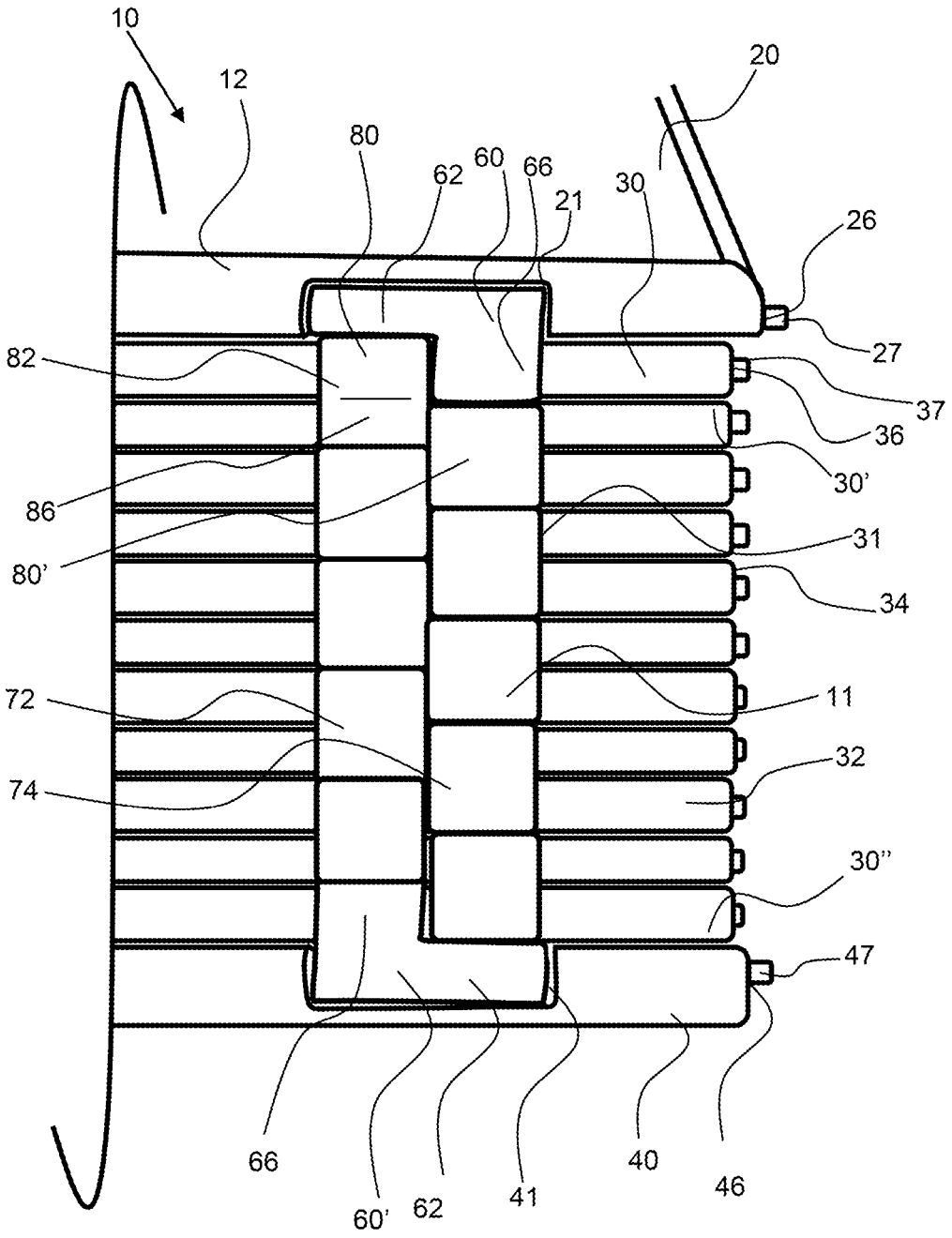
FIG. 4 shows a binding side view of the exemplary interleaved book binding assembly comprising cover binding couplers that extend from a cover to the next adjacent page and page binding couplers that extend between successive pages, wherein the binding couplers are retained by pins extending through a portion of the cover or page and through the apertures in the binding couplers.

As shown in FIG. 4, an exemplary interleaved book binding assembly 10 comprises an interleaved book binding assembly 10. The page binding couplers 80, 80 are configured in an interleaved pattern forming two rows of binding couplers wherein the first row 72 of binding couplers is offset one page from the second row 74 of binding couplers. This alternating and overlapping pattern of binding couplers forms a binding that is integral to the pages, wherein the binding couplers do not extend out substantially from the binding side of the pages 32.

Figure 6:
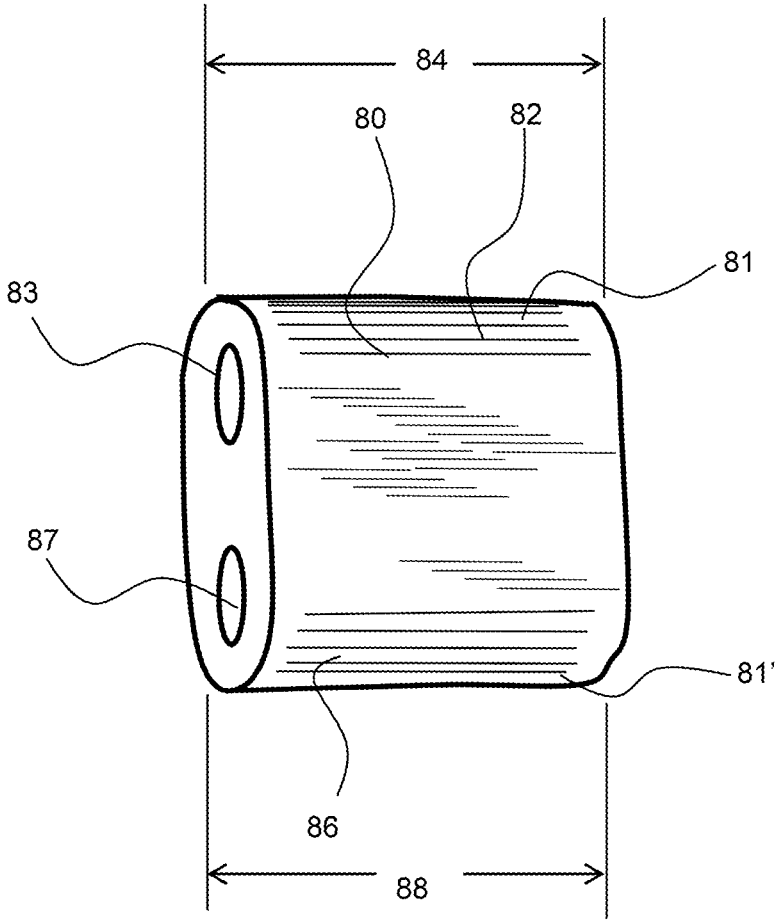
FIG. 6 shows a perspective view of an exemplary page binding coupler having a first page portion and a second page portion, each of said page portions having an aperture for receiving a respective pin.

The front cover 20 is coupled to the binding by a cover binding coupler 60 that extends from the front cover 20 to the first page 30, and the cover binding coupler is L-shaped. Likewise, a back cover binding coupler 60' extends from the back cover 40 to the last page 30" and is L-shaped. The front cover is retained to the binding by a front cover pin 27 that extends through an aperture in the front cover 20 from a top or bottom edge, and then through an aperture 63 in the front cover portion 62 of the front cover binding coupler 60. The first page 30 of the book is coupled to the front cover binding coupler 60 by the page portion 66 of the front cover binding coupler that extends down to align with the first page and has an aperture 36 to receive a page pin 37 that extends through an aperture in the first page 30. The page pin 37 extends through the page aperture and through the page pin receiver of the page portion 66 of the front cover binding coupler before extending back into the page aperture on the opposing side of the front cover binding coupler. The back cover 40 has a back cover pin 47 that extends through an aperture 46 in the back cover from the top or bottom edge, through the cover binding coupler 60' and back into the an aperture in the back cover. Note that the front and/or back cover binding coupler may not have an extended front cover portion 62, and the front and/or back cover may be coupled to the binding and the adjacent page by page binding coupler, as shown in FIG. 6. When there is an odd number of pages, an extended cover binding coupler may be required however.

The first page 30 and second page 30' are coupled together by a page binding coupler 80 having a first page portion 82 and a second page portion 86 that each have apertures to receive a pin extending through the first page 30 and second page 30', respectively. Successive page binding couplers are configured in a stepped arrangement wherein each page binding coupler is configured in an alternating position across the binding 11 or binding side 32. The page binding couplers extend from page to page to produce the interleaved book binding assembly 10.

The front cover has a front cover recess 21, the back cover has a back cover recess 41 and the pages all have a page recess 31 to accommodate the cover binding couplers and the page binding couplers respectively, to enable alignment of the couplers with the pins extending therethrough.

Figure 5:
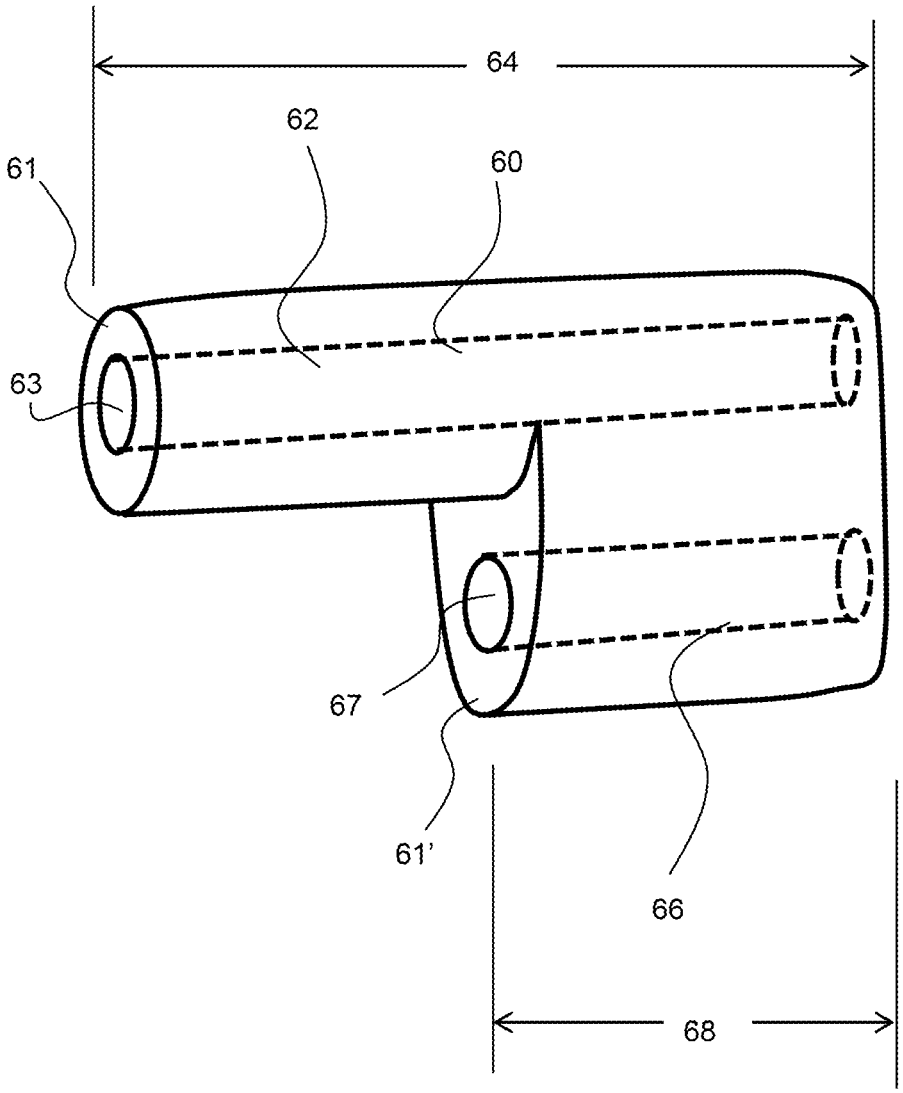
FIG. 5 shows a perspective view of an exemplary cover binding coupler having a cover portion and a page portion, each having an aperture for receiving a respective pin.

As shown in FIG. 5, an exemplary cover binding coupler 60 has a cover portion 62 and a page portion 66. The cover portion extends along the recess of the front or back cover and has a length 64 that is greater than the page portion length 68, thereby producing the L-shaped cover coupler. The cover portion has a cover pin receiver 63 or aperture extending along the length of the cover portion and configured to receive a cover pin. The page portion has a page pin receiver 67 or aperture extending along the length of the page portion and configured to receive a page pin. The cover pin receiver and page pin receiver extend substantially parallel to enable the cover and pages to rotate about the binding. The length of the cover portion may be about double the length of the page portion length of the cover binding coupler. The cover binding coupler 60 has curved edges 61, 61' to allow the cover binding coupler 60 to rotate without interfering with the adjacent page binding coupler.

As shown in FIG. 6, an exemplary page binding coupler 80 has a first page portion 82 and a second page portion 86. The length 84 of the first page portion and the length 88 of the second page portion are substantially the same to allow interleaving of the page couplers to produce the binding. The first page portion has a first page pin receiver 83 and the second page portion has a second page pin receiver 87, each extending through the page binding coupler along the length and substantially parallel with each other. The page binding coupler 80 has curved edges 81, 81' to allow the page binding coupler to rotate without interfering with the adjacent page binding coupler or a cover binding coupler.

Figure 7:
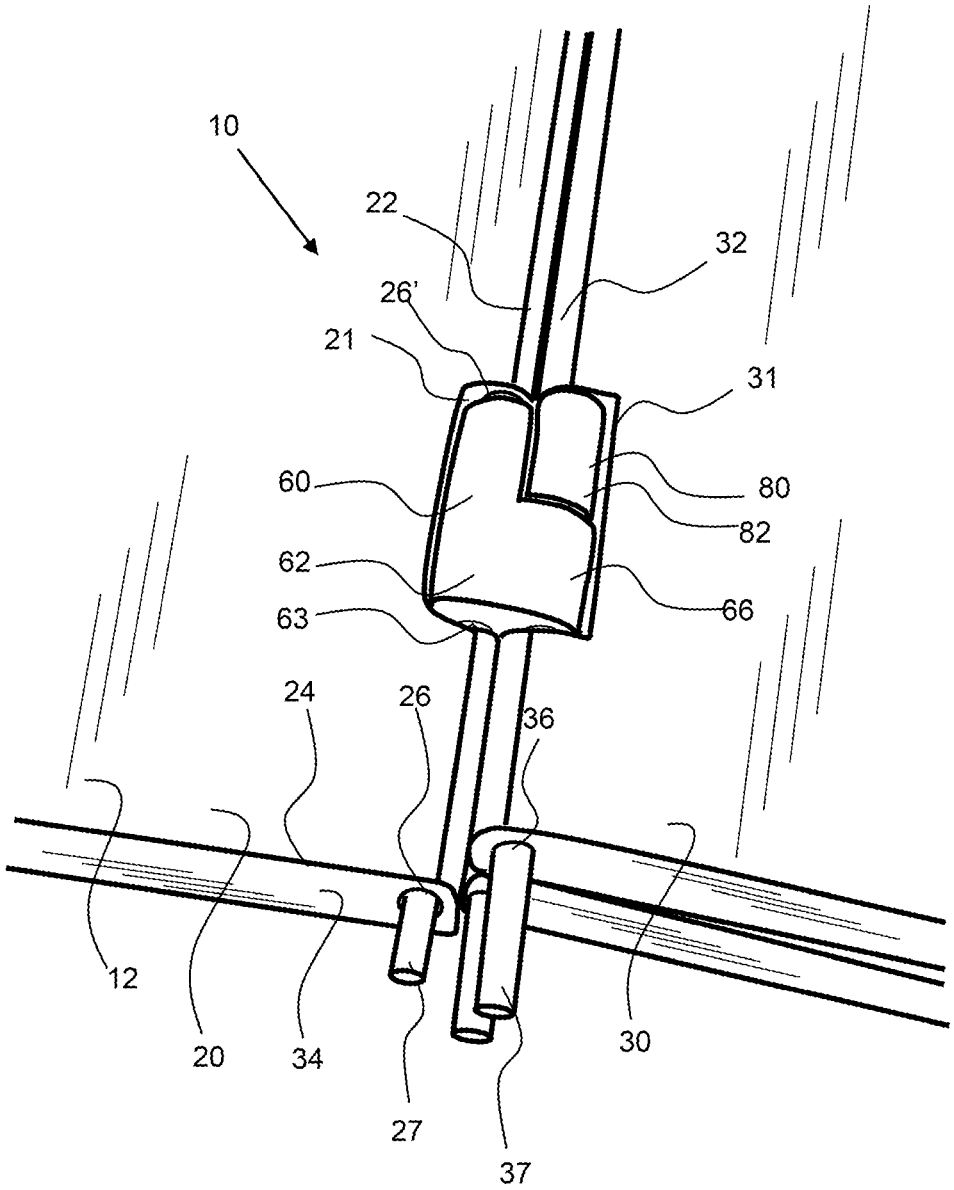
FIG. 7 shows a perspective view of an exemplary rigid paged book with the front cover open to show the cover binding coupler extending from the front cover to the first page of the book and the first page portion of the first of the page binding couplers that are interleaved from page to successive page to produce the binding.

As shown in FIG. 7, an exemplary rigid paged book 12 is configured with an interleaved book binding assembly 10 and has the front cover 20 open to show the cover binding coupler 60 extending from the front cover to the first page 30 of the book and the first page portion 82 of the first of the page binding couplers 80 that interleave from page to successive page to produce the binding. The cover pin 27 extends into the cover page aperture 26 in the front cover along the bottom edge 34 and then into the cover recess 21, into the cover pin receiver 63 of the cover portion 62 of the cover binding coupler 60 and back into the cover page aperture 26' in the front cover. The page pin 37 extends into the page aperture 36 in the first page 30 from the bottom edge 34 and then into the page recess 31, into the page portion 66 of the cover binding coupler 60, then through the first page portion 82 of the page binding coupler 80 and then back into the page aperture of the first page.

Figure 8:
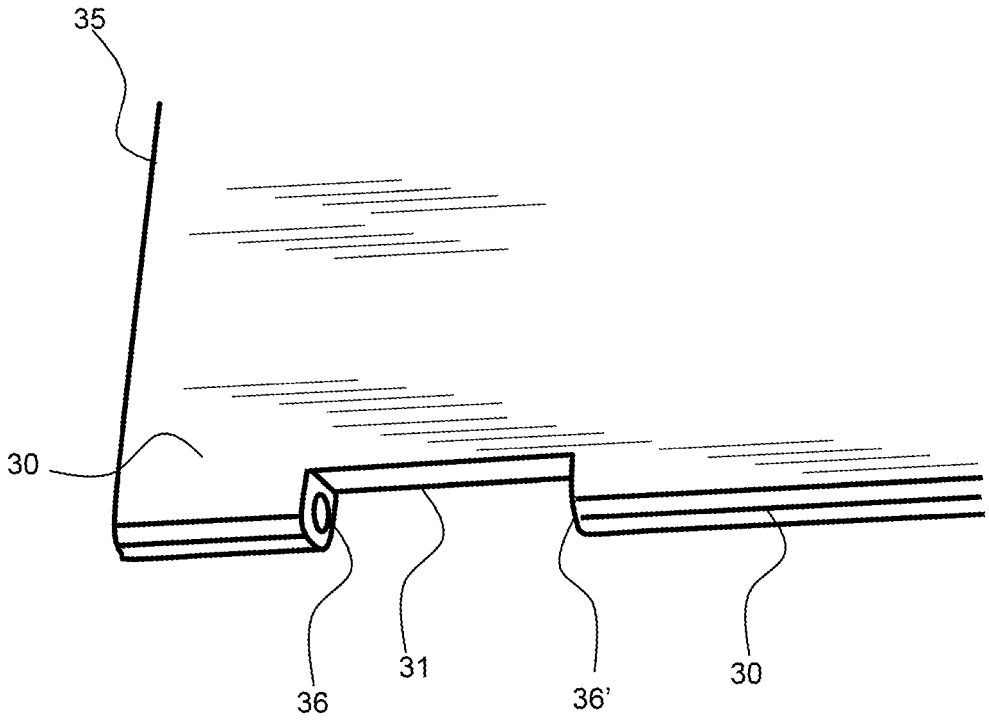
FIG. 8 shows a perspective view of a portion of an exemplary page of a rigid paged book having a page recess for the binding couplers and apertures for receiving the pin.

FIG. 8, shows an exemplary page 30 of an exemplary rigid paged book having a page recess 31 for the page coupler portion and page apertures 36, 36' for receiving a pin that extends through an aperture 36 in the page from the top edge 35 of the page, along the binding side 32 of the page, through the recess and then back into the page aperture 36'. The recess in the page provides room for page binding coupler and when the page is a first or last page, the cover binding coupler.

It will be apparent to those skilled in the art that various modifications, combinations and variations can be made in the present invention without departing from the scope of the invention. Specific embodiments, features and elements described herein may be modified, and/or combined in any suitable manner. Thus, it is intended that the present invention cover the modifications, combinations and variations of this invention provided they come within the scope of the appended claims and their equivalents.

What is claimed is:

1. A rigid paged book comprising:

a) a plurality of pages including a front cover, a first page and a second page, each page having a page aperture extending along a binding side of said page;

b) two interleaved book binding assemblies, each comprising:

i) a plurality of pins comprising:

a front cover pin;

a first page pin;

a second page pin;

ii) a front cover binding coupler configured between and coupling together the front cover and the first page and comprising:

a front cover portion having a front cover pin receiver;

a first page portion having a first page pin receiver;

wherein said front cover pin extends through the page aperture of the front cover and into the front cover pin receiver, wherein said first page pin extends through the page aperture of the first page and into the first page pin receiver;

iii) a first page binding coupler configured between and coupling together said first page and said second page and comprising:

a first page portion having a first page pin receiver;

a second page portion having a second page pin receiver;

wherein said first page pin that extends through the first page portion of the front cover binding coupler also extends through the first page pin receiver of the first page binding coupler;

wherein said second page pin extends through the page aperture of said second page and into the second page pin receiver of the first page binding coupler; and wherein the plurality of pages are rigid and free-standing.

2. The rigid paged book of claim 1, wherein the plurality of pins further comprises a last page pin and a back cover pin;

wherein the plurality of pages further comprises a back cover and a last page;

wherein the two interleaved book binding assemblies each further comprise:

vi) a back cover binding coupler configured between and coupling together said back cover and a last page and comprising:

a back cover portion having a back cover pin receiver;

a last page portion having a last page pin receiver;

wherein said back cover pin extends through the page aperture of the back cover page and into the back cover pin receiver; and wherein said last page pin extends through the page aperture of said last page and into the last page pin receiver.

3. The rigid paged book of claim 1, wherein a first interleaved book binding assembly is configured an offset distance from a second interleaved book binding assembly.

4. The rigid paged book of claim 1, wherein each of the plurality of pins extend through both of the two interleaved book binding assemblies.

5. The rigid paged book of claim 1, wherein the front cover portion of the front cover binding coupler is longer than the first page portion of the front cover binding coupler.

6. The rigid paged book of claim 1, wherein the pin receivers of the front cover binding coupler are apertures extending through the front cover binding coupler.

7. The rigid paged book of claim 1, wherein the plurality of pins further comprises a last page pin and a back cover pin;

wherein the plurality of pages further comprises a back cover and a last page;

wherein the two interleaved book binding assemblies each further comprise:

vi) a back cover binding coupler configured between and coupling together said back cover and a last page and comprising:

a back cover portion having a back cover pin receiver;

a last page portion having a last page pin receiver;

wherein said back cover pin extends through the page aperture of the back cover page and into the back cover pin receiver; and wherein said last page pin extends through the page aperture of said last page and into the last page pin receiver; and wherein the back cover portion of the back cover binding coupler is longer than the last page portion of the back cover binding coupler.

8. The rigid paged book of claim 7, wherein the back cover pin receiver and the last page pin receiver of the back cover binding coupler are apertures extending through the back cover binding coupler.

9. The rigid paged book of claim 1, wherein the first page pin receiver and second page pin receiver of the first page binding coupler are apertures extending through the first page portion and second page portion of the first page binding coupler.

10. The rigid paged book of claim 9, wherein the first page pin extends through the page aperture of the first page from an edge of the first page, through the first page portion of the front cover binding coupler and then into the first page pin receiver of the first page portion of the first page binding coupler and then back into the page aperture of the first page.

11. The rigid paged book of claim 10, wherein the second page pin extends through the page aperture of the second page from an edge of the second page, through the second page portion of the first page binding coupler and then back into the page aperture of the second page.

12. The rigid paged book of claim 1, wherein the plurality of pages are metal pages.

13. The rigid paged book of claim 12, wherein the pages are 3 mm thick or more.

14. The rigid paged book of claim 12, wherein pins are metal and the couplers are metal.

15. The rigid paged book of claim 12, wherein the rigid paged book consists essentially of metal.

16. The rigid paged book of claim 15, wherein the plurality of pages comprises engraved text.

17. The rigid paged book of claim 1, wherein the second page is a back cover.

18. The rigid paged book of claim 1, wherein the interleaved book binding assembly is integral with the plurality of pages, wherein the front cover binding coupler and first page binding coupler do not extend out substantially from the binding side of the pages to enable the pages to open 180 degrees.

19. A rigid paged book comprising:

a) a plurality of pages including a front cover, a first page and a second page, each page having a page aperture extending along a binding side of said page;

b) two interleaved book binding assemblies, each comprising:

i) a plurality of pins comprising:

a front cover pin;

a first page pin;

a second page pin;

ii) a front cover binding coupler configured between and coupling together the front cover and the first page and comprising:

a front cover portion having a front cover pin receiver;

a first page portion having a first page pin receiver;

wherein said front cover pin extends through the page aperture of the front cover and into the front cover pin receiver, wherein said first page pin extends through the page aperture of the first page and into the first page pin receiver;

iii) a first page binding coupler configured between and coupling together said first page and said second page and comprising:

a first page portion having a first page pin receiver;

a second page portion having a second page pin receiver;

wherein said first page pin that extends through the first page portion of the front cover binding coupler also extends through the first page pin receiver of the first page binding coupler;

wherein said second page pin extends through the page aperture of said second page and into the second page pin receiver of the first page binding coupler; and wherein the plurality of pages are rigid and free-standing;

wherein the pin receivers of the front cover binding coupler are apertures extending through the front cover binding coupler; and wherein the pin of the front cover binding coupler extends through an aperture in the front cover from an edge of the front cover, through the front cover portion of the front cover binding coupler and then back into a second aperture in the front cover.

* * * * *